United States Patent [19]

Streeter

[11] Patent Number: 5,009,419

[45] Date of Patent: Apr. 23, 1991

[54] MICROCOMPUTER CONTROLLED ROTATION GAME

[76] Inventor: Willie L. Streeter, 3318 Mount Pleasant St., NW., Washington, D.C. 20010

[21] Appl. No.: 404,951

[22] Filed: Sep. 6, 1989

[51] Int. Cl.[5] ..... A63F 9/24

[52] U.S. Cl. ..... 273/454; 273/1 G;440;460; 434/258

[58] Field of Search ..... 273/1 GE, 1 GC, 1 E, 273/1 G; 434/258

[56] References Cited

U.S. PATENT DOCUMENTS

| | | | |
|---|---|---|---|
| 1,564,138 | 12/1925 | Rowland | 434/258 |
| 2,678,692 | 5/1954 | Ranseen | 434/258 |
| 3,024,020 | 3/1962 | Alton | 273/1 G |
| 3,345,069 | 1/1965 | Kuziak | 273/1 E |
| 3,869,812 | 3/1975 | Arakelian | 434/258 |
| 4,009,880 | 3/1977 | Lammersen | 273/1 G |
| 4,169,592 | 10/1979 | Hall | 434/258 |
| 4,209,087 | 6/1980 | Morrison | 273/1 E |
| 4,285,517 | 8/1981 | Morrison | 273/1 GC |
| 4,309,030 | 1/1982 | Goldfarb et al. | 273/1 E |
| 4,363,482 | 12/1982 | Goldfarb | 273/1 GC |
| 4,627,620 | 12/1986 | Yang | 273/1 GE |

*Primary Examiner*—Edward M. Coven
*Assistant Examiner*—Jessica J. Harrison
*Attorney, Agent, or Firm*—Nies, Kurz, Bergert & Tamburro

[57] ABSTRACT

A game device for development of coordination and concentration among children as well as adults is disclosed. The device includes a microprocessor mounted within a housing having indicia representing a pair of hands and a pair of feet. Each participant has access to four switches operable by the hands and feet. The microprocessor generates a sequence of tones or lights, each being associated with a hand or foot on the housing. A pair of arrows may be mounted on the housing to indicate whether the sequence is proceeding clockwise or counter clockwise. Each participant attempts to repeat the sequence by activating the proper switch shortly after each tone or light or both. Play continues until a participant makes an error at which point play ceases. In another embodiment, the game can be played to control the interaction of two participants with one participant generating a first rotation or random sequence to be repeated by the other participant.

2 Claims, 4 Drawing Sheets

MICROCOMPUTER CONTROLLED ROTATION GAME

BACKGROUND AND SUMMARY OF THE INVENTION

This invention relates generally to games for thinking and to develop coordination and, more particularly, to an electronic board game that provides audible and visual indications both during progress of the game as well as at the end of the game.

Electronic tone producing and musical games and toys are known. One such game device is described in U.S. Pat. No. 4,207,087 to Morrison et al. which is incorporated herein by reference. Such games and toys usually take the form of low cost musical instruments, such as pianos, organs and the like, or musical devices that automatically sequence through a plurality of tones or special effects. Electronically generated musical tones have also been utilized in conjunction with pinball type machines to indicate the progress of the game, and machines that generate a random sequence of numbers which must be guessed by a participant have been devised. However, while these machines do provide a great deal of amusement, such machines generally do not provide a game wherein a participant may play against the machine or with a device that controls the interaction of two participants. Previous machines also do not provide the thinking and physical challenge associated with the game of the present invention.

Accordingly, it is an object of the present invention to provide an electronic game that controls the interaction between two participants, or against the machine itself.

It is another object of the present invention to provide a game for action and thinking that tests the aural and visual memory, as well as the coordination and concentration of a participant, either against the machine or against another participant.

It is a further object of the invention to provide a game that can generate an automatic rotation, or random sequence of events that must be timely repeated by the participant.

It is another object of the invention to provide a microprocessor controlled game for thinking that monitors the progress of the participants.

It is yet another object of the present invention to provide a microprocessor controlled game for thinking that can be programmed to play a variety of games.

In accordance with one embodiment of the invention, there is provided a device for controlling several push-button switches, each associated with a tone or light, or both. The device utilizes a microprocessor to generate a sequence of tones, each associated with a light and one of the keyswitches. The microprocessor is programmed to generate a rotation or random sequence of tones or lights, or both, which must be repeated by a participant by depressing the proper keyswitches shortly after each tone or light or both. If the participant correctly repeats the sequence shortly after each tone or light or both, the machine may add another level to the sequence and play the faster timed sequence which must again be repeated by the participant. The process is repeated to provide a higher level sequence until the participant makes an error or, if desired, until the sequence reaches a predetermined level. The machine then indicates whether the machine or the participant has won, and may be programmed to indicate the highest level sequence successfully repeated. Also, controls may be provided for increasing the speed of the thinking game either manually or automatically as the game progresses.

In another embodiment of the invention, the game can be played to control the interaction of two participants. One participant generates a first rotation or random sequence that must be repeated by the other participant. As in the above, the machine keeps track of the highest sequence successfully repeated and declares a winner when one of the participants makes an error. Also, as in case of the above, the sequence may take the form of a tone sequence, light sequence or both tone and light sequence.

By the present invention, there is provided a game device which is constructed so as to aid in the development of coordination and concentration among children as well as adults. The device provides a display of a pair of hands and a pair of feet with switches to be operated by the corresponding hands and feet of the participants. As one of the hands or feet lights up on the game display, the participant attempts to activate the corresponding switch to match that of the hand or foot which is lighted and then to continue to press additional switches in sequence as additional hands or feet light up in a pattern on the display.

At the top of the game board, a pair of arrows are provided with one arrow pointing to the left and the other to the right. When the game is in the automatic mode, one of the arrows will light up to indicate initially that the game pattern for lighting up the hands and feet will proceed either clockwise or counter clockwise.

When a participant activates the correct corresponding switch relative to the hand or foot which has been lighted, a bell will sound from a microphone speaker located on the game board. When an incorrect switch is pressed, a buzzer will sound and the game comes to an end.

The game may be played by either one or two players and a manual mode is available for use with two players wherein one player may press switches in a rotation or random sequence to light up the hands and feet of the display and the other player then attempts to timely match the sequence of lights and tones or either created by the first player.

DESCRIPTION OF THE PREFERRED EMBODIMENTS

Figure 1:
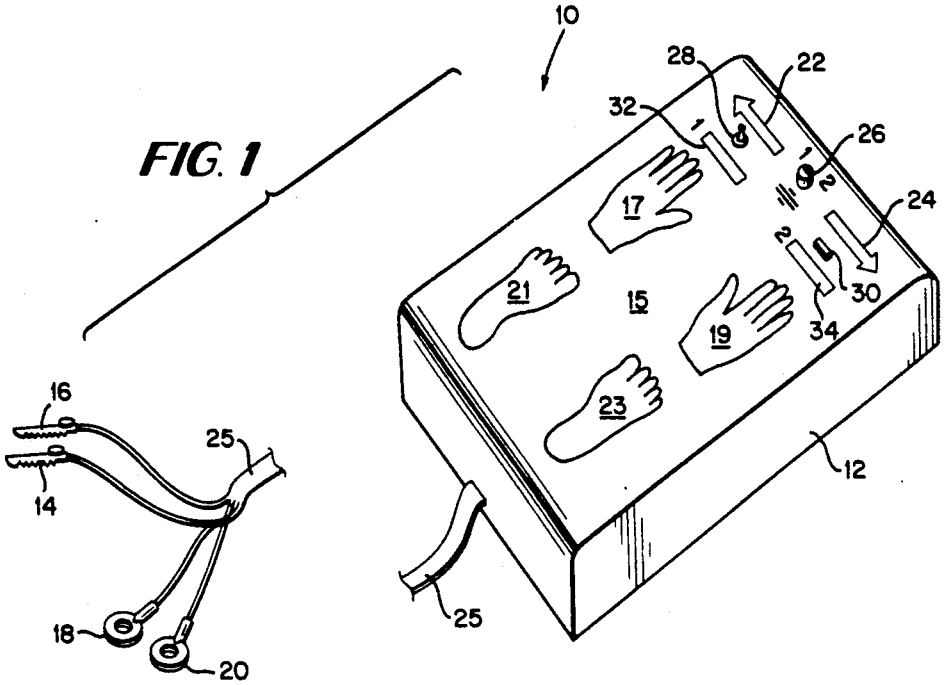
FIG. 1 is a perspective view of a preferred embodiment of the device according to the invention.

Referring now to the drawings, with particular attention to FIG. 1, there is shown an embodiment of the game according to the present invention designated by the reference numeral 10. The rotation game device 10 includes a housing 12 that contains four keyswitches 14, 16, 18 and 20 connected by cable 25 and operated by a participant playing the game. Each of the push-button keyswitches 14, 16, 18 and 20 is associated with a particular tone that is sounded when a respective one of the keyswitches is depressed. Keyswitches 14, 16, 18 and 20 are electrically connected to the housing components by cable 25 and operable by a participant playing the game.

Switches 14 and 16 are for operation by the hands of the participant while switches 18 and 20 are operated by the feet. These switches 14, 16, 18 and 20 may be of the push-button type or any other conventional type of electrical switch which will operate the game equipment and which may be easily activated by the hands and feet. In addition, one of a plurality of indicator lights may be illuminated upon depression of each of the keyswitches.

Figure 2:
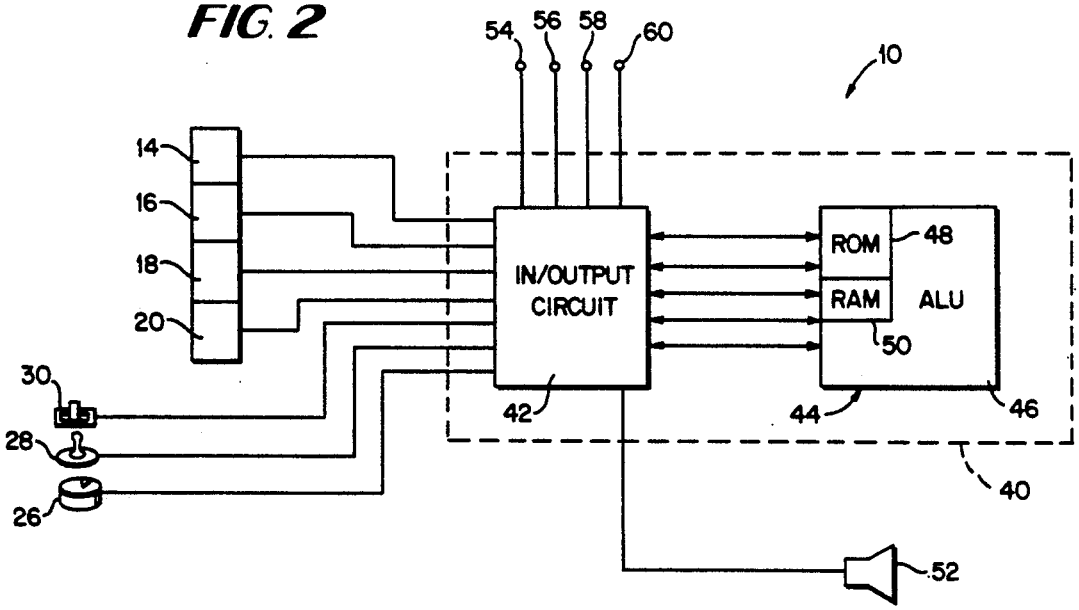
FIG. 2 is a block diagram of the electrical components of the game according to the invention.
Figure 3:
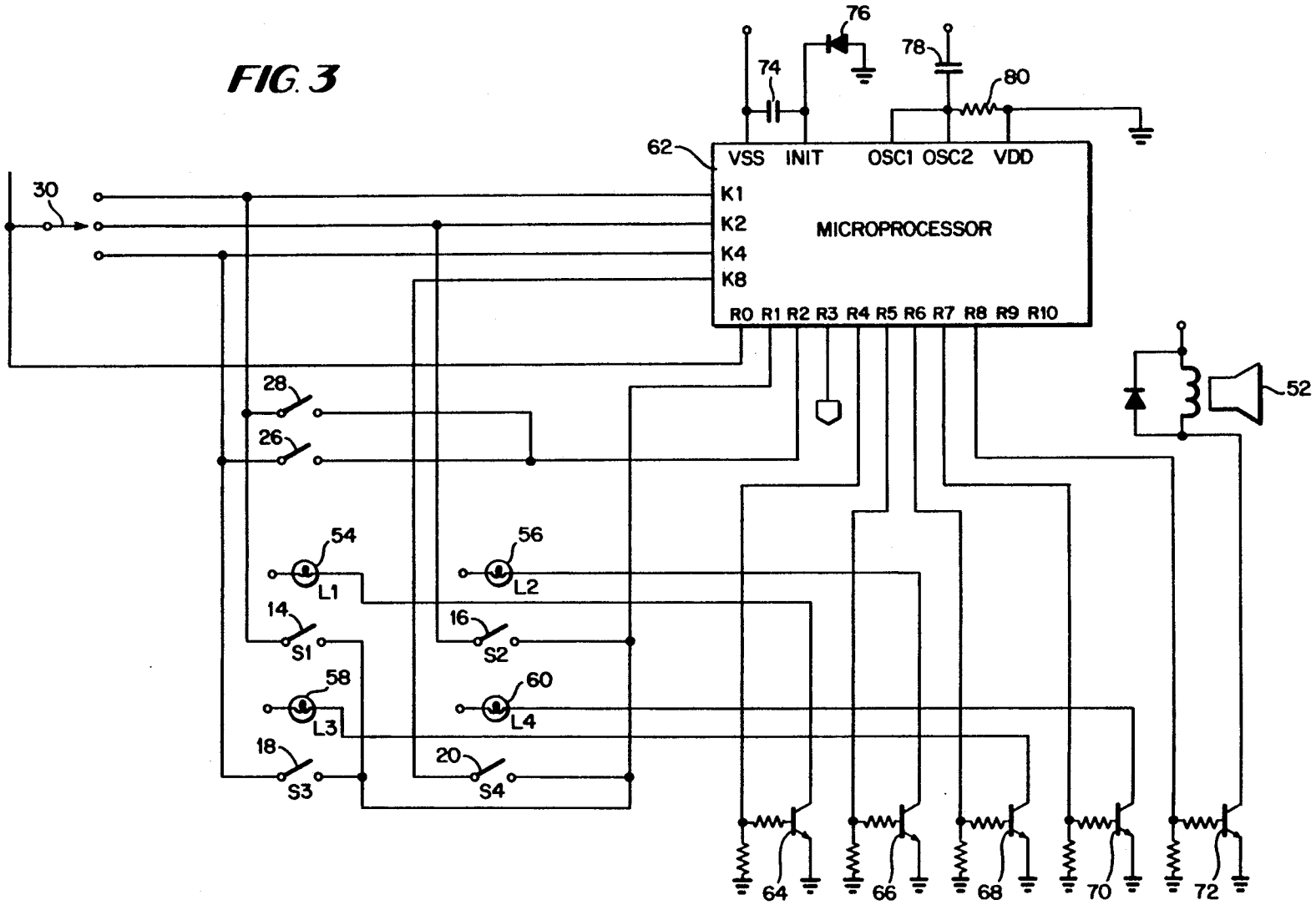
FIG. 3 is a detailed schematic diagram of the electronic circuitry of the game according to the present invention.

In the embodiment illustrated in FIGS. 1 through 3, the indicator lights 54, 56, 58 and 60 are located under the respective hand 17, 19 or foot 21, 23 provided by translucent material on the upper surface 15 of the housing 12 and serve to illuminate the appropriate hand or foot as the switch is depressed. In addition, a pair of arrows 22, 24 are located on the housing upper surface 15 and provided with lights arranged so as to illuminate that arrow which points in the direction in which the pattern of lights is moving, either clockwise or counter clockwise. A switch 26 is provided on the housing 12 to select play for either one or two players. A toggle switch 28 turns the equipment on or off. A selection switch 30 allows selection of either manual or automatic mode. Switch 30 also indicates whether the game is being played by one or two participants.

Score totals for one or two participants are shown in box like display opening 32 and 34 on the housing 12. These display counters 32 and 34 can be of any design that can be easily fitted into the embodiment. When switch 30 is in the manual mode a participant may depress switches 14, 16, 18 and 20 in any order chosen by the participant. The second participant then repeats the sequence by depressing switches 14, 16, 18 and 20 of a second set of keyswitches connected to embodiment 10 by second cable 25. If the second participant correctly completes the sequence, then the first participant can continue by depressing keyswitches 14, 16, 18 and 20 of the first set continuing the game. If the second participant makes an error, a buzzer will sound ending the game.

Each participant can be allowed to go first by changing keyswitches. The first set of keyswitches are always first in the game sequence. When switch 30 is in the automatic position, the game is as programmed in the microprocessor 62. The embodiment of the game device 10 should be designed to accept two cables 25. The lights are separated from the respective push-button keyswitches by cable 25 and serve to illuminate as the keyswitches are depressed. In addition, control switches 26, 28 and 30 are provided which permits the recall of the highest level tone sequence and control of the start of a new game, respectively. A push-button switch 26 permits the user to select one of several games playable by the unit, and a switch 28 selects the level of the sequence that must be achieved for the participant to be declared a winner.

Several games may be played by the device 10 illustrated in FIG. 1. Such games are started by appropriately positioning the switch 28 in the on position. Four games are described below; however, the microprocessor described earlier may be programmed to play other games.

GAME 1

Upon activation of the start of the game for thinking switch 28, the microprocessor will cause the four notes contained in its memory to be rotatedly or randomly sounded. In addition, one of the directional lights 22 or 24 will illuminate. One of the four lights 17, 19, 21 and 23 associated with a particular one of the keyswitches 14, 16, 18 and 20 will be illuminated. The participating player must now timely depress the keyswitch associated with the tone, as indicated by the illumination of its associated lights of 14, 16, 18 and 20. If the participant depresses the correct one of the keyswitches 14, 16, 18 and 20 the machine repeats the previous tone and light sequence. The game continues with the participant and the device repeating the entire prior sequence, and with the machine always adding one or more levels to the prior sequence. At the first occurrence of an erroneous key entry, the microprocessor causes a distinctive error signal (buzzer) to be sounded. This concludes the game sequence. Also, the microprocessor may be programmed to generate a second distinctive "win" signal when the sequence reaches a predetermined level. For example, the length of such a level sequence may be selected to be 8, 10 or 20 rotations by appropriately programming the microprocessor 62. Finally, the microprocessor 62 may be programmed to increase the speed of the sequence, as the game is played to make the game more challenging.

After the conclusion of the game sequence, the participant has the option of starting a new game by depressing the on/off switch 28. Upon such a command, the microprocessor will automatically sound out the entire sequence of tones that had been programmed to begin a repeat of the first game. The highest points obtained can be reviewed by depressing the selection switch 26.

GAME 2

Game 2 is selected by appropriately depressing switch 30 until two tones (chimes) are sounded. In this game, the participant repeats the previous timed sequence and continues as long as he/she follows the sequence properly. The microprocessor 62 is programmed to keep track of the last sequence, and to sound the error signal whenever the participant makes an error. As in the case of game 1, the highest level tone sequence played by the participants during any continuous series of games may be stored, and the pushbutton switch 30 can be used to recall the higher sequence. In this manner, it is possible for the winner of a game to compare his performance with the highest tone sequence in the memory.

GAME 3

This game is essentially a modification of either game 1 or game 2 wherein the participant must respond within a shorter predetermined time interval, for example, before the tone ends, or before its associated light is extinguished. If the player reacts too slowly, or makes an error, the game ends.

GAME 4

In this game, the device is programmed to remember not only the sequence of keyswitch entries, but also to remember the length of time that each keyswitch is depressed and the time interval between such depressions. Thus, the device can be programmed to play tunes that are within the four tone capability of the device. If these tones are properly selected to correspond to the tones formed in a bugle, then most familiar bugle calls could be keyed in the machine.

The above games have been given as examples only, and the number of possible games is limited only by the capability of the microprocessor within the device and the ingenuity of the programmer. The number of games that may be played can be considerably greater than the four examples given.

Referring to FIG. 2, the device 10 utilizes a microprocessor 40 having an input/output section 42 connecting the manually operable switches 14, 16, 18 and 20 to a computing device 44 having an arithmetic logic unit 46, a read-only memory 48, and a random-access memory 50. The arithmetic logic unit processes the inputs received from the various input devices in accordance with the game selected from the read-only memory 48 by the selection switch 30 and serves to operate a loud speaker 52 and four light indicators 54, 56, 58 and 60, each associated with a respective one of the keyswitches 14, 16, 18 and 20, in accordance with the rules of the game selected. Thus, when one of the games stored in the read-only memory 48 is selected by the switch 30, the arithmetic logic unit 46 operates on the inputs from the keyswitches 14, 16, 18 and 20, to perform the necessary arithmetic logic steps and to store the necessary data, such as the level of the last sequence into the random-access memory 50. The arithmetic logic unit 46 also serves to provide the necessary responses to the participant by appropriately lighting up the lights 54, 56, 58 and 60, and sounding the appropriate tone or error signal through the loud speaker 52.

Referring to FIG. 3, the device 10 can readily be implemented utilizing a single chip, large scale integrated circuit microprocessor 62 as the main computing device. A TMS1OOO single chip microprocessor manufactured by Texas Instruments, Inc. is suitable for use as the microprocessor 62, and contains the input/output circuitry 42 and computing device 44 illustrated in FIG. 2. Driver transistors 64, 66, 68, 70 and 72, serving as part of the input/output circuitry 42, are driven by outputs of the microprocessor 62, and serve to drive the lights 22, 24, 54, 56, 58 and 60, and the loud speaker 52. A time delay circuit comprising a capacitor 74 and a diode 76 serve to reset and initiate the operation of the microprocessor each time the power is turned on. A timing circuit comprising a capacitor 78 and a resistor 80 controls the operation of the internal clock of the microprocessor 62.

The microprocessor 62 monitors the state of the play keyswitches 14, 16, 18 and 20, the control switches 26 and 28 and the game selector switch 30 by sequentially energizing its outputs R0–R10 while monitoring its inputs K1, K2, K4 and K8. Thus, when the output R0 is energized, the device can determine the position of the keyswitch 30 by determining which of its inputs K1, K2 or K4 is energized. Similarly, the microprocessor R1 can determine which of the switches 14, 16, 18 and 20 is energized by monitoring the four inputs K1, K2, K4 and K8 during the time that the output R1 is energized. In a similar manner, the device monitors the inputs K1, K2 and K4 during the time that the output R2 is energized to determine which, if any, of the switches 26, 28 and 30 are energized. The outputs R4–R8 are utilized to drive the driving transistors 64, 66, 68, 70 and 72 which, in turn, drive the indicator lights 54, 56, 58 and 60 and the loud speaker 52.

The microprocessor 62 is readily programmed in a manner described in the TMS1OOO series data manual published in December 1975 by Texas Instruments, Inc. to perform the functions necessary to play the desired games. Flow charts illustrating the programming of the microprocessor are shown in FIGS. 4 through 6.

Figure 4:
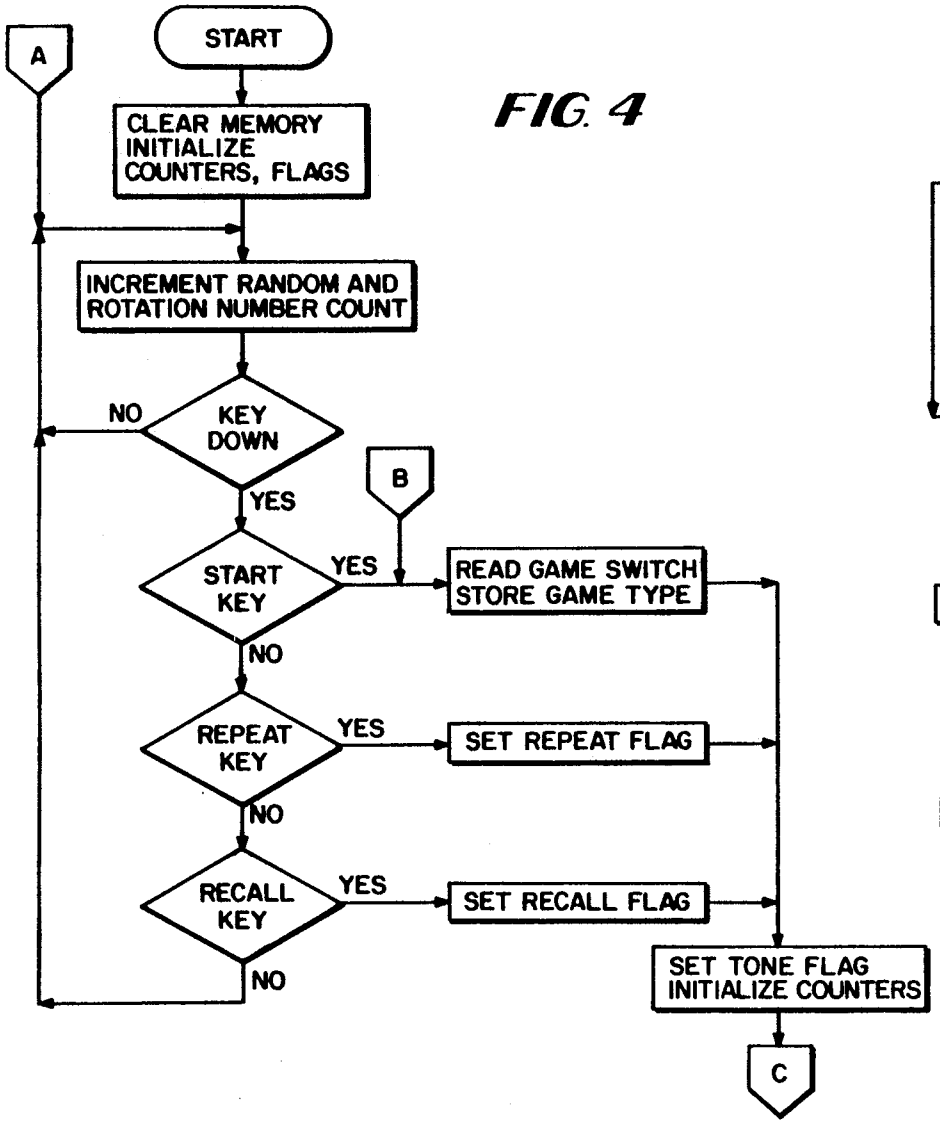

When the start switch 28 is placed in the on position, the memory of the microprocessor 62 is cleared and the random number count is incremented (FIG. 4). A determination is made whether any of the push-button keys are depressed. If not, the random number count is continuously incremented. If one of the keys is depressed, a determination is made to determine which of the keys has been depressed. If the start key has been depressed, the microprocessor 62 reads the position of the game selecting switch 30 and selects the stored game corresponding to that position. If the key requesting the repeat of the last sequence or the key requesting the recall of the highest level sequence is depressed, the appropriate repeat or recall flag is set. Also, the tone flag is set and the counters are initialized.

Figure 5:
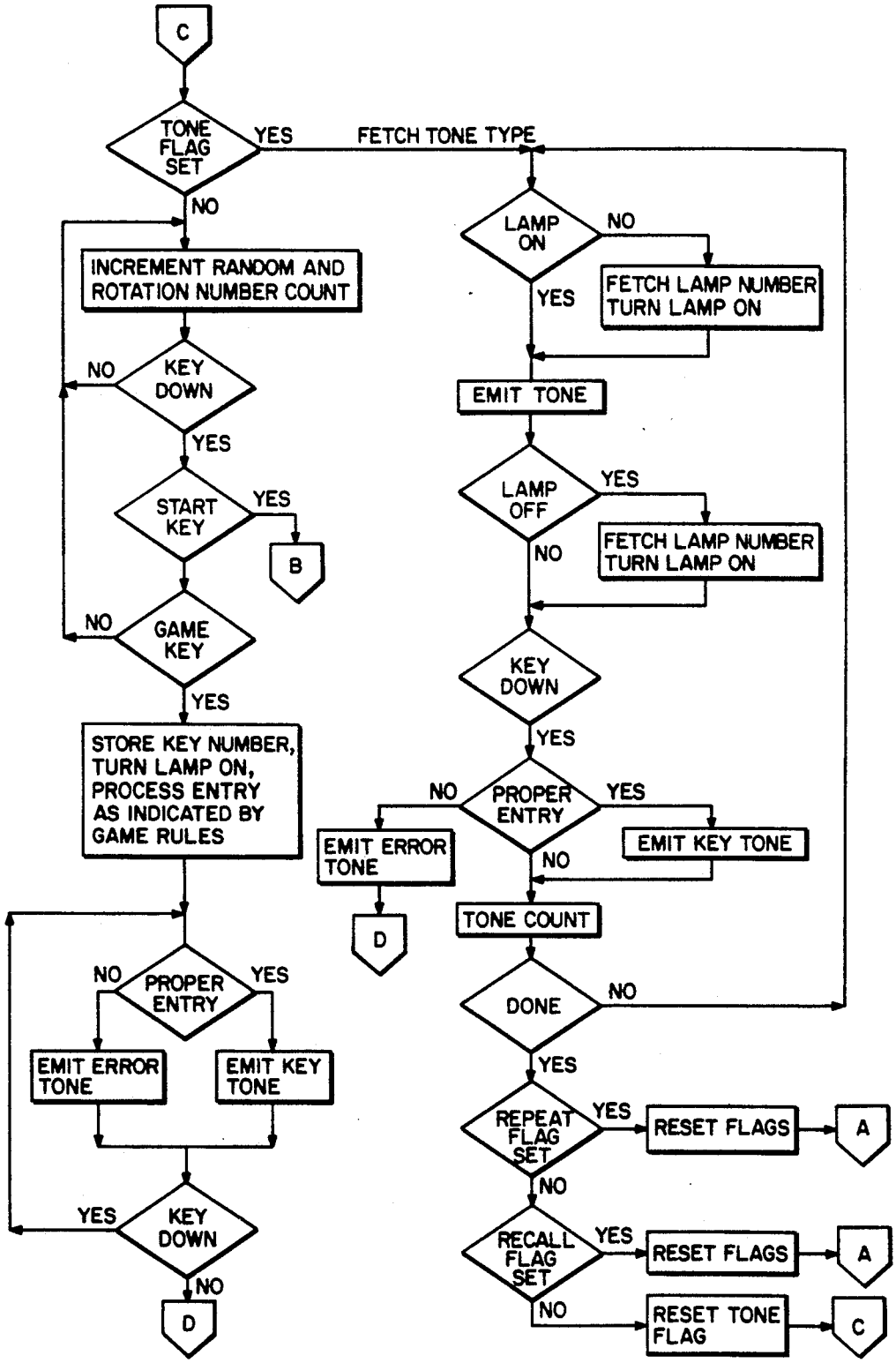
FIGS. 4–6 are logical flow chats illustrating the functions performed by the microprocessor controlling the operation of the game according to the invention.
Figure 6:
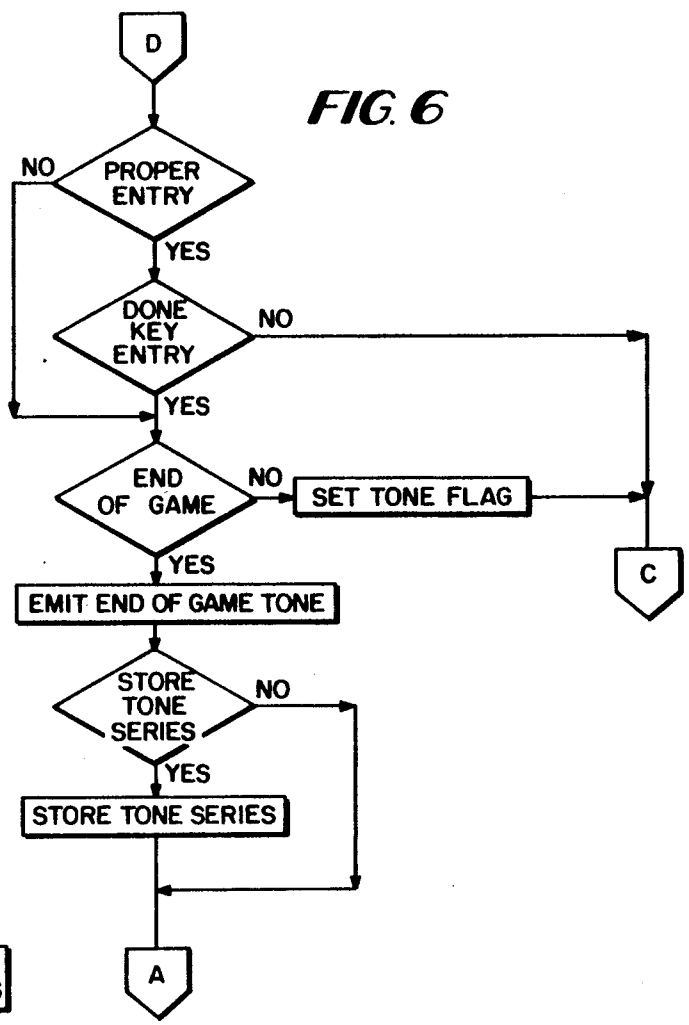

If the start key has been placed in the on position, causing the appropriate game to be stored, the tone to be flag set and the counters to be initialized, the setting of the tone flag causes a particular tone type to be fetched (FIG. 5). A determination is then made whether the lamp associated with that tone type is on. If the lamp is on, the tone is emitted, otherwise the lamp is first turned on and the tone emitted. After the tone has been emitted, the lamp is turned off and the tone count incremented. If the repeat and recall flags are not set, which is normally the case during the time that a game is being played, the tone flag is reset. After the tone flag is reset, another determination is made to determine whether a key is depressed (left branch of FIG. 5). If one of the game keys is depressed, a determination is made to determine whether the proper entry, as dictated by the game rules, has been depressed. Based on this determination, either an error tone or a tone corresponding to the depressed game key is sounded. At the same time, if the entry is not proper, an end of the game tone is sounded (FIG. 6) and tone series stored. If the entry is proper and the game is not otherwise terminated, the tone flag is again set and the next tone is sequence generated (FIG. 5) until an error occurs.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A game device for development of coordination of the hands and feet of a game participant, comprising:

a housing;

indicia representing a pair of hands and a pair of feet located on the surface of said housing;

means for generating a sensorially perceptible time sequence of events in the form of light or sound or a combination of light and sound, said sequence generating means including means for generating a plurality of distinct sensorially perceptible events in a predetermined time sequence and at a predetermined time rate;

means for communicating said sensorially perceptible time sequence of events to a game participant, wherein each event of the sequence is associated with one of the indicia representing hands and feet;

means actuable by a participant for responding to said time sequence of events, said participant actuable means including a plurality of manually operable controls, each associated with a single one of said distinct sensorially perceptible events and actuable by the participant in response to one of said distinct events, said participant actuable means including at least four separate controls wherein each of said controls requires actuation by a different one of said participant's hands and feet in response to a stimulus by the sensorially perceptible event and the indicia representing the hands and feet, whereby coordination is developed in the use of the hands and feet of the participant;

means coupled to said time sequence generating means and to said participant actuable means for determining the correctness of the participant's response, said correctness determining means including means for storing a representation of the generated sequence of events and means for comparing the stored sequences with the participant's response, said comparing means including means for providing an indication of the correctness or incorrectness of the response; and means responsive to said indication of incorrectness for generating an error signal;

wherein said indicia are mounted so that said pair of hands and pair of feet define a generally circular pattern and wherein said sequence of sensorially perceptible events is selectively actuable so as to generate either a random pattern of said hands and feet indicia or a pattern of said hands and feet indicia which is clockwise or counter clockwise.

2. The game device of claim 1 further including indicia means mounted on said housing for indicating whether said sensorially perceptible events are occurring in a clockwise or counter clockwise pattern.

* * * * *